US006058525A

United States Patent [19]

Paden

[11] Patent Number: 6,058,525

[45] Date of Patent: May 9, 2000

[54] WASTE AND OVERFLOW FITTINGS

[75] Inventor: Kent Paden, Folsom, Calif.

[73] Assignee: Plumbing Innovations, L.L.C., Rocklin, Calif.

[21] Appl. No.: 09/208,658

[22] Filed: Dec. 10, 1998

Related U.S. Application Data

[63] Continuation-in-part of application No. 08/907,065, Aug. 6, 1997, abandoned, which is a continuation-in-part of application No. 08/605,273, Feb. 6, 1996, abandoned.

[51] Int. Cl.[7] ..... E03C 1/22

[52] U.S. Cl. ..... 4/680; 4/287; 4/694

[58] Field of Search ..... 4/287, 288, 289, 4/292, 650, 651, 652, 653, 679, 680, 682, 683, 684, 685, 694

[56] References Cited

U.S. PATENT DOCUMENTS

| | | | |
|---|---|---|---|
| 10,049 | 9/1853 | Mott | 4/584 |
| 412,195 | 10/1889 | Marker | 4/289 |
| 728,059 | 5/1903 | Weed | 4/287 |
| 989,410 | 4/1911 | Peters | 4/289 |
| 1,051,394 | 1/1913 | Dunlap | 4/651 |
| 1,745,002 | 1/1930 | Brotz | 4/584 |
| 1,867,725 | 7/1932 | Botz | 4/584 |
| 1,931,568 | 10/1933 | Brotz | 4/584 |
| 2,017,416 | 10/1935 | Mallet et al. | 4/651 |
| 2,171,133 | 8/1939 | Stanton | 4/584 |
| 2,413,811 | 1/1947 | Coordes | 4/651 |
| 2,464,645 | 3/1949 | Lassa | 4/584 |
| 2,486,246 | 10/1949 | Beeke | 4/694 X |
| 2,635,254 | 4/1953 | Steele | 4/683 |
| 2,871,487 | 2/1959 | Fife | 4/683 |
| 3,283,340 | 11/1966 | McMurtrie et al. | 4/584 |
| 3,493,978 | 2/1970 | Hindman et al. | 4/694 |
| 3,578,737 | 5/1971 | Ruggles et al. | 4/631 |
| 3,859,675 | 1/1975 | Van Manen et al. | 4/651 |
| 3,927,428 | 12/1975 | Jette et al. | 4/694 |
| 4,188,676 | 2/1980 | Tolnai et al. | 4/295 |
| 4,207,632 | 6/1980 | Savell, Jr. et al. | 4/288 |
| 4,209,862 | 7/1980 | Cortes-Garza | 4/651 X |
| 4,669,131 | 6/1987 | Barlow | 4/683 |
| 4,920,582 | 5/1990 | Alker | 4/683 |
| 4,937,899 | 7/1990 | Morris et al. | 4/651 |
| 4,947,494 | 8/1990 | Moreland | 4/683 |
| 5,325,549 | 7/1994 | Cornwall | 4/679 |

FOREIGN PATENT DOCUMENTS

| | | |
|---|---|---|
| 2171383 | 9/1996 | Canada . |
| 2192219 | 2/1974 | France . |
| 241770 | 7/1995 | New Zealand . |
| 659419 | 10/1951 | United Kingdom . |
| 913970 | 12/1962 | United Kingdom . |

OTHER PUBLICATIONS

Disclosure document (335901, dated May 28, 1993) of bathtub having built–in waste and overflow, communicated beginning about Feb. 25, 1994, to third parties (6 pages).

European Search Report for Application No. 96942948.9 (European counterpart to U.S. Serial No. 09/208,658) showing relevance of non–English language foreign patent document designated as "B5" above.

*Primary Examiner*—Robert M. Fetsuga

*Attorney, Agent, or Firm*—Majestic, Parsons, Siebert & Hsue, P.C.

[57] ABSTRACT

A multi-piece waste and overflow unit is used with a bathtub to remove waste water via the overflow drain hole, bottom drain hole, or both holes of the bathtub. The multi-piece waste and overflow unit includes a bottom connector and overflow connector. Both connectors comprise a tubular member, a flange extending radially outwardly with respect to the tubular member, and a frustoconical connector between and connecting the tubular member and the flange. The flanges have a channel formed thereon to receive leakproof adhesive for connecting the connectors to the bathtub respectively. The multi-piece waste and overflow unit also utilizes elbows, T-joints, and conventional pipes for connecting the bottom and overflow connectors.

14 Claims, 4 Drawing Sheets

WASTE AND OVERFLOW FITTINGS

This is a continuation-in-part of U.S. patent application Ser. No. 08/907,065, filed Aug. 6, 1997, now abandoned, which was a continuation-in-part of U.S. patent application Ser. No. 08/605,273, filed Feb. 6, 1996, now abandoned, both incorporated herein by reference.

FIELD OF THE INVENTION

The present invention generally relates to bathtub drain connections. More particularly, the invention relates to bathtub drain connectors that are adhered to a bathtub at the overflow and bottom drain holes and preferably are parts of a multiple-piece waste and overflow unit that avoids mechanical connections to the bathtub.

BACKGROUND OF THE INVENTION

This invention relates to plumbing designs for bathtubs. Bathtubs typically have overflow drains which prevent the bathtub from being filled beyond a certain level. These overflow drains prevent the overflow of water from the bathtub and its resulting damage.

Currently, a multiple-piece waste and overflow unit is connected to the overflow and bottom drains of a bathtub. This multiple-piece waste and overflow unit comprises overflow and bottom connectors for attachment to the overflow and the bottom drains respectively, pipes attached to both of these connectors, and an additional elbow or ell to connect the two pipes together. Most bathtubs have an "overflow" wall, where the overflow drain is located, that is inclined at approximately between 86°–88° measured from the floor to the back side of the overflow wall. Moreover, increasingly the new style of bathtub have their overflow wall angle varying even more from perpendicular, i.e., the angle is below 86°–88°. The construction of previous art forces the overflow to connect to the sanitary T at 90° resulting in torque leading to a poor fit into the Sanitary T.

With respect to the overflow connector and its connection to the overflow drain, a rubber gasket is typically interposed between the overflow connector and the back of the bathtub and thus is used as a seal. In order to hold both the overflow connector and the rubber gasket against the bathtub, a screw is placed through an overflow cover plate and then is connected to the overflow connector, which contains a threaded hole for the screw connection. This connection mechanically holds both the overflow connector and the rubber gasket to the back of the bathtub and also mechanically holds the overflow cover plate against the bathtub water-holding surface. The problem associated with this prior art overflow connection is that the rubber gasket seal may be installed off center, can be over tightened resulting in cracking, may deteriorate overtime or may become loose such that water flowing through the overflow drain will leak and subsequently cause damage. In particular, children may loosen the overflow cover plate by playing with the overflow lever. Additionally, if the overflow connector is accidentally disattached, it is difficult to repair because of the inaccessibility to the multi-piece waste and overflow unit since most bathtubs have no trap door access to reach the waste and overflow unit after installation.

With respect to the bottom connector and its connection to the bottom drain, a rubber gasket is also interposed between the bottom connector and the bottom of the bathtub and thus is used as a first seal. The inner wall of the bottom connector is threaded so that a threaded strainer can be screwed into the bottom connector. But before the threaded strainer is mechanically connected to the bottom connector, plumber putty is placed on the underside of the trim of the threaded strainer to provide an additional second seal. Thus, this connection holds the bottom connector, the rubber gasket, and the threaded strainer to the bottom drain hole of the bathtub. However, this bottom drain connection has three disadvantages. First, since typically the multiple-piece waste and overflow unit, including the bottom connector, is made out of plastic while the threaded strainer is made out of metal, the threaded strainer will expand and contract when its temperature increases and decreases, respectively. When the threaded strainer expands, so does the plastic bottom connector and eventually the plastic bottom connector will crack and cause leaks. Second, if a plumber wants to replace a rusted strainer, the replacement process is time consuming because [1] the plumber must disrupt the mechanical connection and the two seals before installing a new strainer and [2] since the threaded strainer mechanically holds the bottom connector against the bottom drain hole, once the rusted strainer is removed, the bottom connector will move downward and away from the bottom drain hole so as to make the connection of the new strainer to the bottom connector more difficult because there is no trap door access to the bottom connector. And third, the prior art bottom connectors are designed such that only a normal connection between the multi-piece waste and overflow unit and the bathtub is possible. In the normal connection, the T-joint or sanitary tee is not directly below the bottom drain hole. Typically, this type of connection provides a poor draining rate and is susceptible to clogging.

Furthermore, the prior art multi-piece waste and overflow units require that during installation a "flood" test, which tests the plumbing connection to the overflow drain hole for leaks, must be performed separately from, not simultaneously with, a "top-out" test, which tests the plumbing connection to the bottom drain hole for leaks. The reason is that the overflow drain hole must be covered with a test plug during a top-test. If the prior art unit is attached to the bathtub at both the overflow and bottom drain holes, the top-out test cannot be performed because the overflow connector of the prior art unit relies on the screw and the overflow cover plate to mechanically hold it against the bathtub; thus, the overflow cover plate blocks or prevents the insertion of a test plug into the overflow drain hole. As a result, to perform the top-out test, only the bottom connector of the prior art unit is mechanically attached to the bottom drain hole. Therefore, top-out and flood tests cannot be performed simultaneously during mandatory plumbing inspection because the overflow connector is not attached to the bathtub. Accordingly, plumbing inspection is time consuming because after the top-test is performed, the inspector must remain or return at another time and wait for the installation of the overflow connector and cover plate so that a flood test can be performed.

Moreover, these waste and overflow units are not readily adaptable to special structural problems caused by difficult floor and wall spacings such as silent floor systems or doubled-up joists located directly behind the bathtub.

It is desired to have a plumbing design for a bathtub that avoids the disadvantages and problems of the prior art systems.

SUMMARY OF THE INVENTION

In one aspect of the present invention, an overflow connector comprises [1] a tubular member, [2] a flange extending radially outwardly with respect to the tubular member, and [3] a frustoconical connector between and connecting the tubular member and the flange. The overflow connector is unitarily formed so that the flange of the overflow connector is tilted with respect to the tubular member. The frustoconical connector provides the tubular member with an inclination with respect to the flange. Thus, when the flange is adhered to the bathtub, regardless of bathtub overflow wall angle, the tubular member is readily affixed to standard or customized other connecting pieces. That is, even when the bathtub wall is tilted at various angles, the frustoconical connector of the overflow connector permits placing the tubular member within a wide range of desired positions with respect to the ground when the overflow connector is attached to the bathtub. Thus, once the flange of the unit is attached to the bathtub at the overflow drain hole, the tubular member will protrude and be positioned correctly for attachment to a conventional ell or elbow such as 22°, 45°, 67°, or 90° elbow.

In a preferred embodiment, the overflow connector is part of a multi-piece waste and overflow unit, which also contains a bottom connector for the bottom drain hole. The bottom connector also comprises [1] a tubular member, [2] a flange extending radially outwardly with respect to the tubular member, and [3] a frustoconical connector between and connecting the tubular member and the flange. Similar to the overflow connector, the bottom connector is also unitarily formed. The primary difference between the overflow and bottom connectors is that the flange of the bottom connector is perpendicular with respect to its tubular member. The flanges of both the overflow and bottom connectors with adhesive can be non-mechanically attached to the unused side of the bathtub at the overflow and bottom drain hole respectively. In addition, the present inventive multi-piece waste and overflow unit also utilizes elbows or ells, T-joints, and pipes to connect the bottom and overflow connectors together. Effectively, the multi-piece waste and overflow unit has a variety of connection options available in positioning due to the inclined tubular member of the connectors.

One advantage of the multi-piece waste and overflow unit of the present invention is that, since adhesive is used to connect the bottom and overflow connectors to the bathtub, these connectors will not become loose from the bathtub, causing a leak that is not accessible for repair. The adhesive used to connect the bottom connector and overflow connector is believed to be leakproof. Thus, the leak problem of the prior art waste and overflow units is avoided.

Additionally, the bottom connector is formed so that once it is adhesively attached to the bathtub, a strainer can be placed on top of the water-holding surface of the bathtub and thus is within but not touching the bottom connector. Thus, even if, for example, hot water causes the strainer to expand, the expansion of the strainer when its metal temperature increases has no effect and will not crack the bottom connector.

Yet another advantage of the present invention is that plumbers can quickly replace rusted strainers with new strainers with ease because the bottom connectors of the present invention are not mechanically attached to the strainers and also the strainers are not sealed to the bathtub with plumber putty.

Yet another advantage of the invention is that since the overflow connector is a non-mechanical part, i.e., it is not mechanically fastened to the bathtub but rather is adhesively attached, the plumbing connections can be simultaneously tested in a flood test and in a top-out test. This is because the inventive unit after its installation will accept a test plug in either the overflow drain, the bottom drain, or both drains.

Yet another advantage of the invention is that the frustoconical connector of the overflow connectors permits the plumber doing the installation to rotate the flange against the overflow wall of bathtubs having various overflow wall angles until the protruding tubular member is correctly positioned for the desired elbow being fastened thereto, which may, but need not, be a 90° elbow.

Yet another advantage of the invention is allowing the plumber to choose his or her preferred method of connection such as [1] a "wet-vent" connection where the sanitary tee is positioned below the bottom drain so as to increase the draining rate or [2] a normal connection where the sanitary tee is not below the bottom drain.

The above advantages and other features and aspects of the present invention will become more apparent upon reading the following detailed description in conjunction with the accompanying drawings.

DETAILED DESCRIPTION OF THE PREFERRED EMBODIMENTS

Figure 1A:
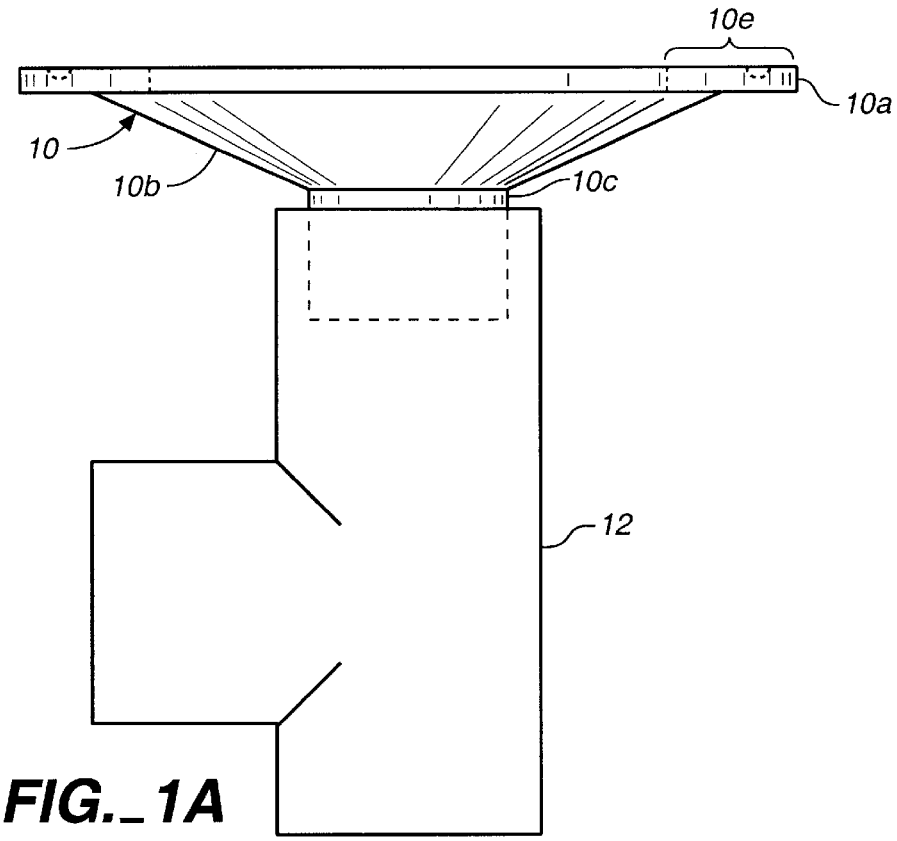
FIG. 1A shows a side view of a bottom connector of the present invention connecting to a T-joint.

In FIG. 1A, a bottom connector 10 connects to a T-joint 12 for use in the multi-piece waste and overflow unit of the present invention. The bottom connector 10 comprises a tubular member 10*c*, a flange 10*a* extending radially outwardly with respect to the tubular member and having a flange face 10*e*, a frustoconical connector 10*b* between and connecting the tubular member 10*c* and the flange 10*a*. The tubular member 10*c* has an outer surface diameter so that the T-joint 12 or a pipe can fit over it. In addition, the flange 10*a* is perpendicular with respect to the tubular member 10*c*. Furthermore, the frustoconical connector 10*b* has sufficient dimensions so that a strainer (e.g., see FIG. 3, element 44) can fit therein but does not touch the frustoconical connector 10*b*. Thus, there is no mechanical connection between the strainer and the bottom connector 10. Therefore, plumbers can quickly replace rusted strainers with new strainers with ease.

Figure 1B:
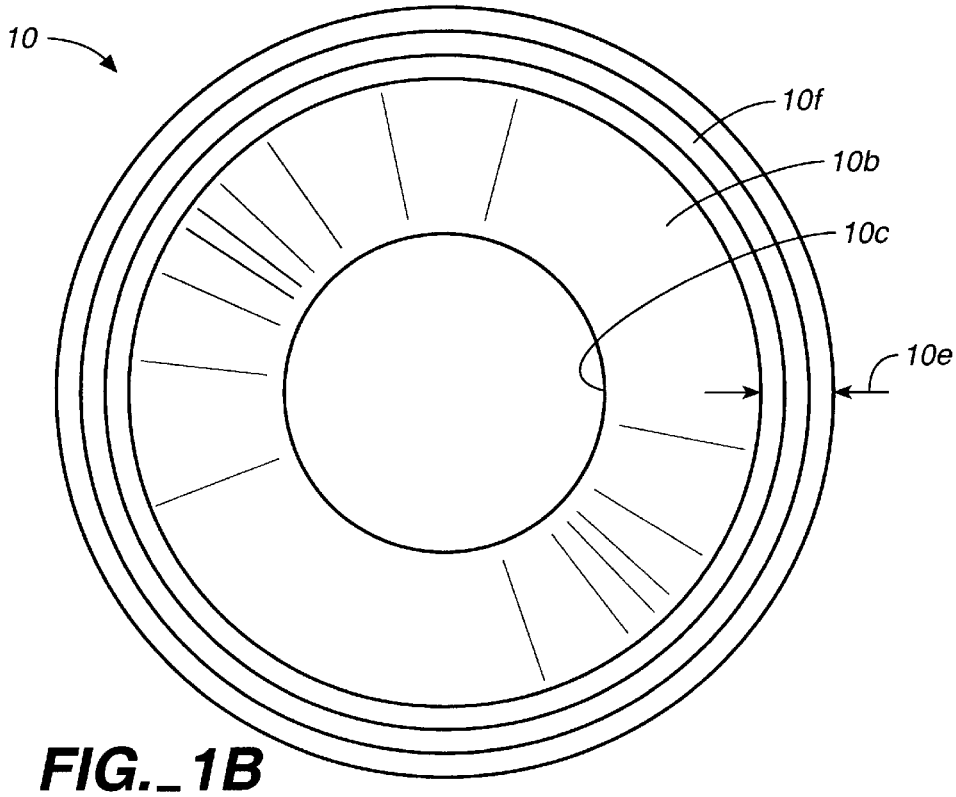
FIG. 1B illustrates a top view of the bottom connector of FIG. 1A.

FIG. 1B shows a top view of the bottom connector 10 of FIG. 1A. Here, note that the flange face 10*e* is relatively wide and is adapted to attach around the bottom drain of a bathtub via leakproof adhesive. The flange face 10*e* contains a channel 10*f* to hold enough adhesive so as to provide a strong, non-mechanical connection between the bottom connector 10 and the bottom drain of the bathtub. In addition, note that the inner wall of the tubular member 10*c* is not threaded unlike the inner wall of the prior art bottom connector. In a preferred embodiment, the flange face 10*e* is one-half inch wide, and the outer surface diameter of the tubular member 10*c* is preferably 1⅝ inches.

Figure 2A:
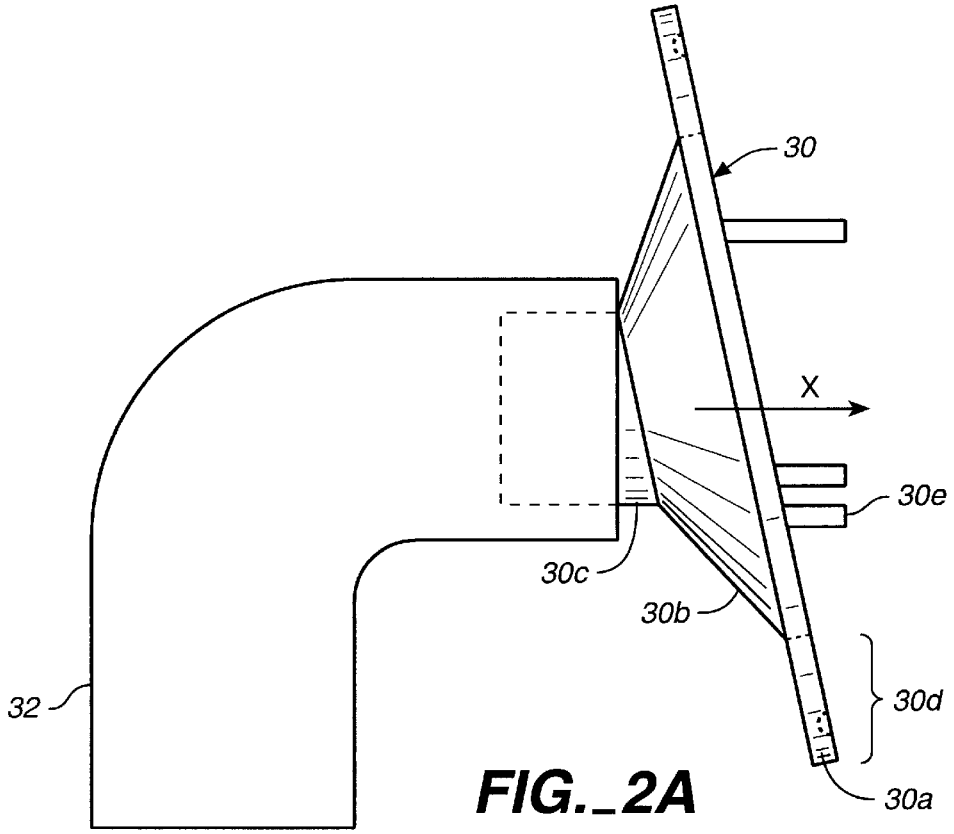
FIG. 2A shows a side view of an overflow connector of the present invention connecting to a 90° elbow.

Referring to FIG. 2A, an overflow connector 30 connecting to a 90° elbow joint 32 is shown. The overflow connector 30 comprises a tubular member 30*c*, a flange 30*a* extending radially outwardly with respect to the tubular member and having a flange face 30*d*, a frustoconical connector 30*b* between and connecting the tubular member 30*c* and the flange 30*a*. Unlike the flange of the bottom connector, note that the flange 30*a* is essentially tilted with respect to the tubular member 30*c* so that the overflow connector 30 can be connected to a tilted wall portion of the bathtub (frequently about 86°–88° with respect to ground) while the tubular member 30*c* would be substantially parallel to a ground plane. In addition, the frustoconical connector 30*b* provides an inclination between the flange 30*a* and the tubular member 30*c* so that when the overflow connector 30 is adhesively attached to the bathtub, the tubular member 30*c* is positioned within a wide range of desired positions with respect to the ground even when the overflow wall has different overflow wall angles. That is, once the flange 30*a* is attached to the bathtub at the overflow drain hole, the tubular member 30*c* will protrude and be positioned correctly for attachment to a conventional ell or elbow such as 22°, 45°, 67°, or 90° elbow. Furthermore, the flange face 30*d* has a channel (not shown) formed thereon to receive a bead of epoxy for non-mechanically connecting the overflow connector 30 to the bathtub.

Preferably, the flange face 30*d* of the flange 30*a* has a sufficient width, for example, is one-half inch wide, to provide a good adhesive contact with the bathtub. The tubular member 30*c* of the overflow connector 30 preferably has a 1⅝-inch outer diameter in the preferred embodiment.

Figure 2B:
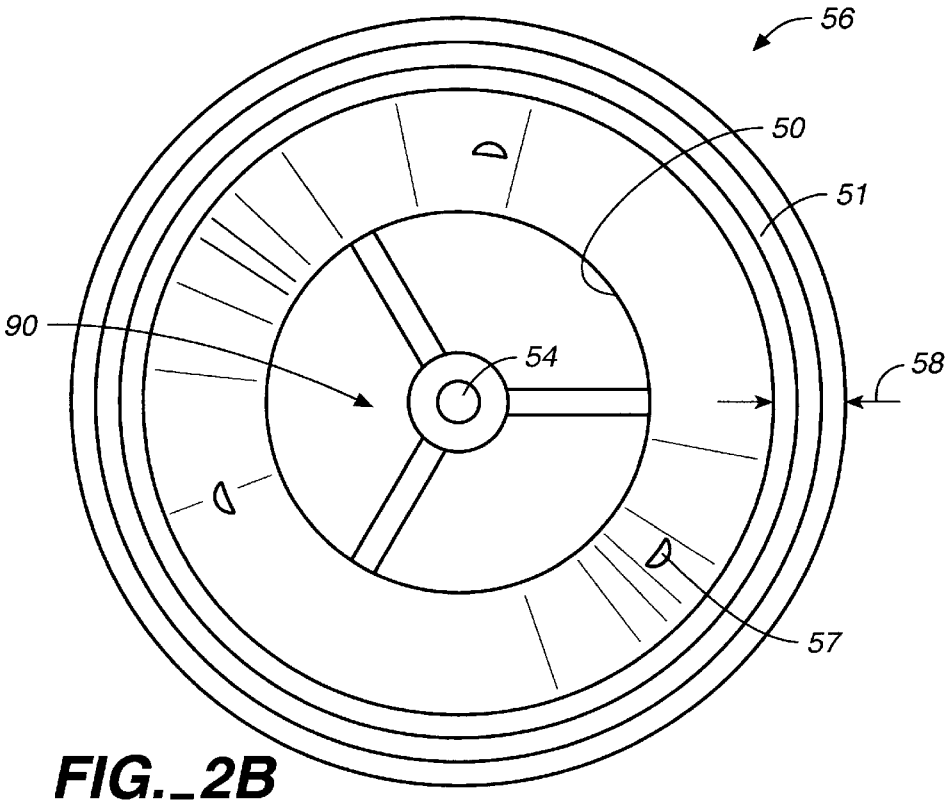
FIG. 2B illustrates a right view of a first embodiment of the overflow connector.

FIG. 2B shows a right view of a first embodiment of an overflow connector 56. A wheel 90 is fixedly disposed within a tubular member 50 and has a tapped, threaded hole 54 to provide a screw connection for a decorative overflow cover plate (not shown but see, e.g., element 42 of FIG. 3). The present inventive overflow connector 56 contains the wheel 90 to accommodate prior art overflow cover plates which can be held against the bathtub by a screw connected to the tapped, threaded hole 54 of the overflow connector 56. The wheel 90 is recessed from the flange face 58 to leave room for a test plug. Furthermore, note that a flange face 58 contains a channel 51 for receiving adhesive so that the overflow connector 56 can be adhesively attached to the bathtub at the overflow drain hole; thus, unlike the prior art, the inventive overflow connector 56 does not rely on the screw in conjunction with the overflow cover plate to provide the overflow connector 56 with a mechanical attachment to the bathtub. If desired, the overflow cover plate can be mechanically attached to the overflow connector 56 for decorative purposes after the overflow connector is adhesively attached to the bathtub. Accordingly, once the overflow connector 56 is adhesively attached to the bathtub and is ready for flood testing, the recession allows a test plug (not shown) to be inserted therein. After installation testing is finished, the decorative overflow cover plate should then be attached to the overflow connector 56.

Figure 2C:
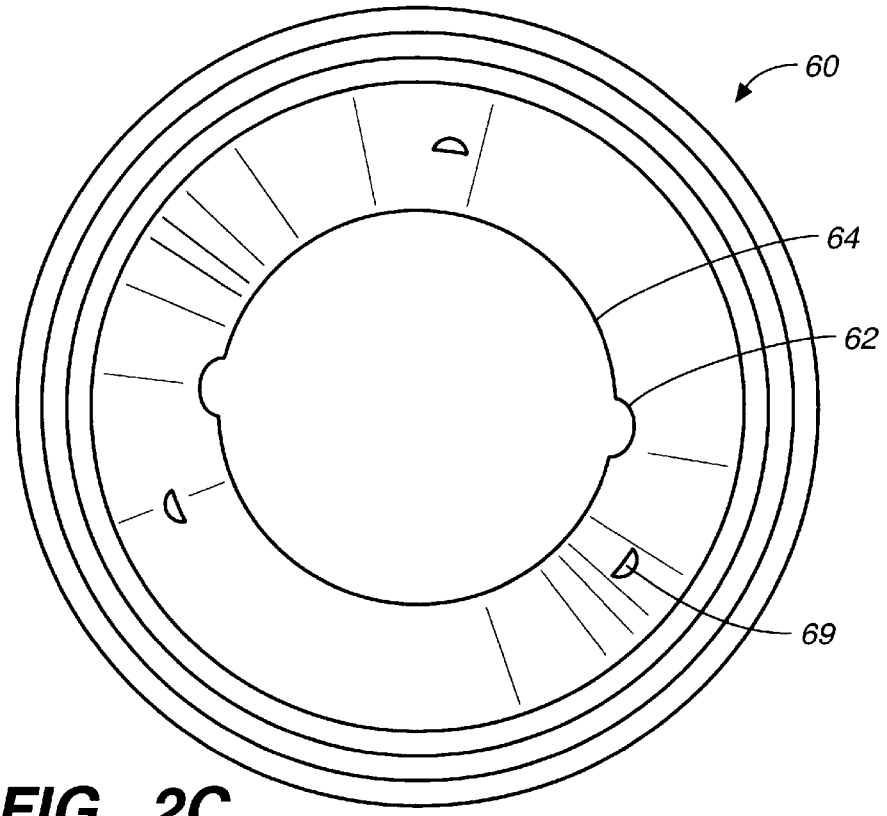
FIG. 2C shows a right view of a preferred second embodiment of the overflow connector in which the inner wall of its tubular member has grooves formed thereon.

FIG. 2C illustrates a right view of a preferred second embodiment of an overflow connector 60 of the present invention. Once the overflow connector 60 is adhesively attached to the bathtub, a test plug can be inserted therein before performing a top-out test. However, the overflow connector 60 of FIG. 2C does not contain a wheel with a tapped, threaded hole to accommodate the mechanical attachment of the conventional overflow cover plate via a screw. Instead, the overflow connector 60 contains grooves 62 formed on the inner wall of a tubular member 64 to be used in conjunction with a decorative overflow cover plate 66 shown in FIG. 2D. With reference to both FIGS. 2C and 2D, flexible extensions 68 of the decorative overflow cover plate 66 can be squeezed toward each other as they are being inserted into the overflow connector 60. Thereafter, the grooves 62 will receive the flexible extensions 68 so that the decorative overflow cover plate 66 is securely held against the overflow drain hole of the bathtub. Accordingly, once the overflow connector 60 is adhesively attached, the flood test can be performed with the insertion of the test plug, and if desired, the decorative overflow cover plate 66 can be attached to the bathtub so as to cover the overflow drain hole after such test.

Furthermore, locating pins 30*e*, 57, and 69 of FIGS. 2A, 2B and 2C, respectively, extend from the inner wall of the frustoconical connector. These locating pins are useful in positioning the overflow connector in the overflow drain hole of the bathtub while rotating the overflow connector into the desired position for attachment to the pipe connecting elements that connect the overflow connector and the bottom connector.

Figure 3:
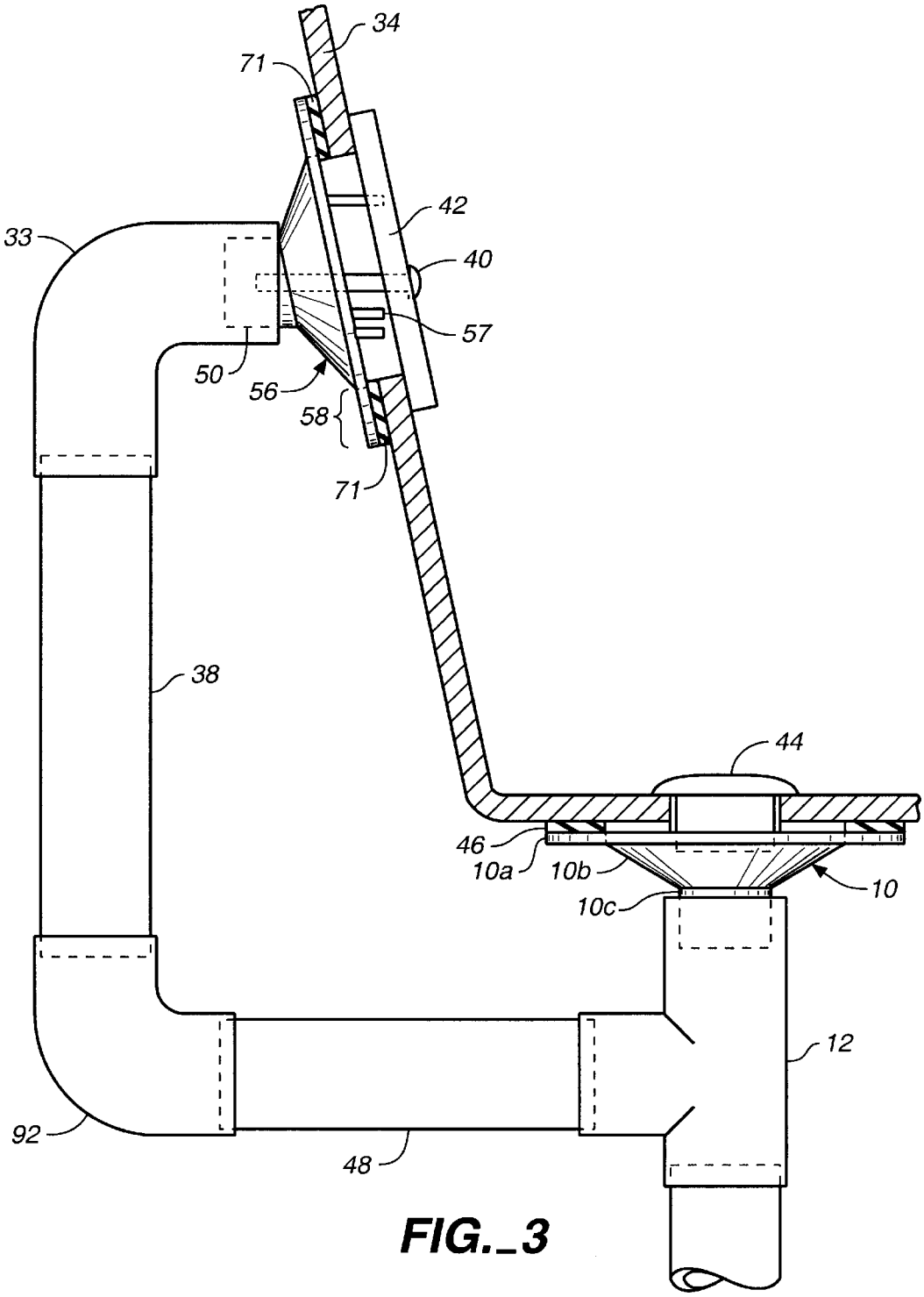
FIG. 3 is a preferred "wet vent" connection illustrating the use of the bottom and overflow connectors in a multi-piece waste and overflow unit connected to a bathtub.

The connection of the overflow connector 56 of FIG. 2B and the bottom connector 10 of FIGS. 1A and 1B to the bathtub is best seen with respect to FIG. 3. In FIG. 3, the overflow connector 56 includes the flange face 58 for connection by adhesive 71 to the back of the overflow wall of a bathtub 34. Recall that the flange face 58 includes the channel 51 (see FIG. 2B) to receive adhesive for non-mechanically connecting the overflow connector 56 to bathtub 34. In a preferred embodiment, the adhesive 71 is urethane. The tubular member 50 of the overflow connector 56 is connected to an elbow joint 33 which is connected to a pipe 38. A screw 40 connects a decorative overflow cover plate 42 to the wheel 90 through its tapped, threaded hole 54. Both the wheel 90 and its tapped, threaded hole 54 are not illustrated in FIG. 3 but are shown in FIG. 2B. Referring again to FIG. 3, the decorative overflow plate 42 includes a hole (not shown) for draining. Note that the overflow connector 56 does not rely on the screw 40 in conjunction with the decorative overflow cover plate 42 for the attachment between the overflow connector 56 and the bathtub 34. The decorative overflow cover plate 42 is merely for decorative purposes since the overflow connector 56 is connected by the adhesive 71 to the bathtub 34.

Figure 2D:
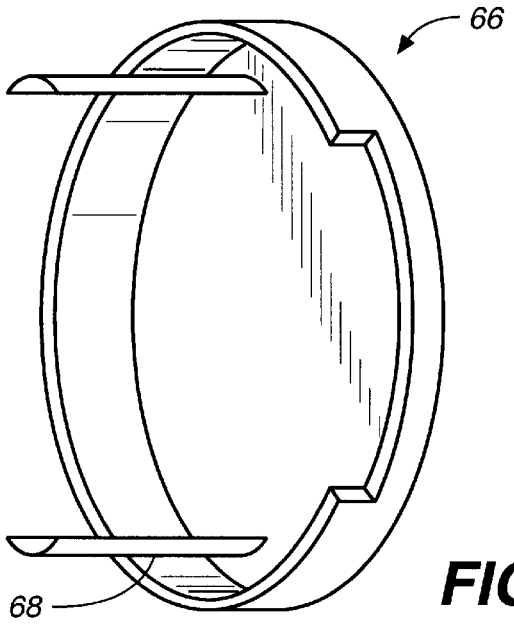
FIG. 2D illustrates an exploded side view of a decorative overflow cover plate with flexible extensions for use in conjunction with the preferred second embodiment of the overflow connector of FIG. 2C.

In a preferred embodiment, the overflow connector 60 of FIG. 2C and the decorative overflow cover plate 66 of FIG. 2D are used instead of the overflow connector 56 and the decorative overflow cover plate 42. In particular, the overflow connector 60 and the decorative overflow cover plate 66 should be used when installing new bathtubs, while the overflow connector 60 and the decorative overflow cover plate 42 should be used when fixing existing bathtubs.

Furthermore, in FIG. 3, the bottom connector 10 of FIGS. 1A and 1B is attached by adhesive 46 to the bathtub 34 around the bottom drain hole. This embodiment of the bottom connector 10 allows strainer a 44 to cover the bottom drain hole. Unlike the prior art, note that the strainer 44 [1] does not touch the frustoconical connector 10*b* of the bottom connector 10, [2] is non-mechanically attached to the bottom connector 10 and [3] is not sealed to the bottom water-holding surface of the bathtub. Therefore, when the strainer 44 is rusted, it can be replaced with ease by anyone. The bottom connector 10 is preferably connected to a pipe 48 via the T-joint 12 or a sanitary tee to allow the waste water to drain out. Pipes 38 and 48 are connected by a 90° elbow 92. This type of connection where the sanitary tee is directly below the bottom drain hole allows the tub to drain at a much greater rate and provides for flexibility in the location of the final connection which cannot be accomplished with prior art. If desired, a plumber can connect the bottom connector 10 to the pipe 48 via a 90° elbow and the pipe 48 to the pipe 38 via a T-joint or a sanitary tee. This type of connection where the sanitary tee is not directly below bottom drain hole is known as normal connection.

Once both the overflow and bottom connectors are adhesively attached to the bathtub, the top-out test and flood test can be performed simultaneously by inserting a test ball through the drain opening into the sanitary tee or by inserting test plugs into both the overflow and bottom drain holes. In contrast, once the prior art multi-piece waste and overflow unit is attached to the bathtub, the top-out test can not be conducted since a test plug cannot be inserted into the overflow drain hole as previously discussed. Thus, to conduct a top-out test, only the bottom connector of the prior art unit is attached to the bathtub so that test plugs can be inserted into the bottom drain hole and into the unattached overflow connector. Once the top-out test is completed, the overflow connector can be attached to the bathtub. Then, the flood-test can be performed. Therefore, both the top-out and flood tests cannot be conducted simultaneously if the prior art unit is used.

In preferred embodiments, the overflow and bottom connectors are made of plastic. The plastic material can be acroylononitrile butadiene styrene (ABS) plastic or polyvinyl chloride (PVC) plastic. In addition, the bottom and overflow connectors of the present are preferably unitarily formed by injection molding.

Additionally, the bottom and overflow connectors can be provided in kits, such as waste and overflow kits, which are popularly sold in home-improvement stores. The kits can be packaged with an adhesive for connecting to the outside of the bathtub. The connectors are sized such that standard pipes and other joints can be added to form the multi-piece waste and overflow unit.

In summary, both the bottom and overflow connectors are non-mechanically connected to the bathtub via leakproof adhesive. Particularly, the overflow connector does not rely on a mechanical screw connection via the overflow cover plate because overflow cover plate is merely used for decorative purposes. The unitary plastic connectors eliminate the need for firm rubber gaskets for use at the overflow and bottom drain holes. With respect to the overflow connector, the frustoconical connector between and connecting the flange and the tubular member compensates for bathtub tilt at the overflow drain hole and allows for a choice in the use of fittings. In one embodiment, the overflow connector contains a wheel with a tapped, threaded hole so as to provide a screw connection for the attachment of a conventional decorative overflow cover plate. Furthermore, the wheel of this embodiment is recessed to accommodate the commonly used test plug. In the preferred embodiment, the overflow connector contains grooves for use in conjunction a decorative overflow cover plate with flexible extensions. In addition, this preferred embodiment is also capable of accommodating a test plug during a flood test once the overflow connector is adhesively attached to the bathtub. Since both the overflow and bottom connectors can receive test plugs after they have been adhesively attached to the bathtub, both the top-out and flood tests can be conducted simultaneously to reduce inspection time. Lastly, the inventive drain connector allows for flexibility in the final connection to the P-Trap be it directly below the drain, which is the preferred type when installing new bathtubs and which provides good draining rate, or the normal connection, which is used when fixing a plumbing unit in existing bathtubs.

It is to be understood that while the invention has been described above in conjunction with preferred specific embodiments, the description and examples are intended to illustrate and not limit the scope of the invention, which is defined by the scope of the appended claims.

It is claimed:

1. A bathtub drain connector, comprising:

a tubular member;

a flange extending radially outwardly with respect to the tubular member; and a frustoconical connector between and connecting the tubular member and the flange, wherein the frustoconical connector has locating pins extending away from the tubular member.

2. The bathtub drain connector as in claim 1 which is unitarily formed by injection molding.

3. The bathtub drain connector as in claim 1, wherein the flange has a channel formed thereon for receiving adhesive to non-mechanically connect the bathtub drain connector and a bathtub.

4. The bathtub drain connector as in claim 1, wherein the flange is perpendicular with respect to the tubular member.

5. The bathtub drain connector as in claim 1, wherein the flange is tilted with respect to the tubular member.

6. The bathtub drain connector as in claim 1, wherein the tubular member has a wheel carrying a tapped, threaded hole and being recessed from the flange.

7. A multi-piece waste and overflow unit, comprising:

a unitary overflow drain connector having a flange, a frustoconical connector, and a tubular member, wherein the flange has a channel formed thereon for receiving adhesive for non-mechanically connecting the overflow drain connector to an overflow drain of a bathtub, wherein the flange is tilted with respect to the tubular member;

a unitary bottom drain connector having a flange, a frustoconical connector, and a tubular member, wherein the flange has a channel formed thereon for receiving adhesive for non-mechanically connecting the overflow drain connector to a bottom drain of the bathtub, wherein the flange is perpendicular with respect to the tubular member; and one or more elbows, T-joints, and pipes connecting the overflow drain connector and the bottom drain connector together.

8. A bathtub structure, comprising:

a bathtub having an overflow drain and a bottom drain;

a unitary overflow drain connector having a flange, a frustoconical connector, and a tubular member, wherein the flange has a channel formed thereon for receiving adhesive for non-mechanically connecting the overflow drain connector to the overflow drain of the bathtub, and farther wherein the flange is tilted with respect to the tubular member;

a unitary bottom drain connector having a flange, a frustoconical connector, and a tubular member, wherein the flange has a channel formed thereon for receiving adhesive for non-mechanically connecting the overflow drain connector to the bottom drain of the bathtub, and further wherein the flange is perpendicular with respect to the tubular member; and one or more elbows, T-joints, and pipes of a sufficient construction to connect the overflow drain connector and the bottom drain connector together.

9. A bathtub drain connector, comprising:

a tubular member;

a flange extending radially outwardly with respect to the tubular member; and a frustoconical connector between and connecting the tubular member and the flange, wherein the tubular member has grooves formed thereon to receive flexible extensions of a decorative overflow cover plate so that the decorative overflow cover plate is securely held against a water-holding surface of the bathtub.

10. The bathtub drain connector as in claim 9 which is unitarily formed by injection molding.

11. The bathtub drain connector as in claim 9, wherein the flange has a channel formed thereon for receiving adhesive to non-mechanically connect the bathtub drain connector and a bathtub.

12. The bathtub drain connector as in claim 9, wherein the flange is perpendicular with respect to the tubular member.

13. The bathtub drain connector as in claim 9, wherein the flange is tilted with respect to the tubular member.

14. The bathtub drain connector as in claim 9, wherein the tubular member has a wheel carrying a tapped, threaded hole and being recessed from the flange.

* * * * *